US012264682B2

(12) United States Patent
Ishihara et al.

(10) Patent No.: US 12,264,682 B2
(45) Date of Patent: Apr. 1, 2025

(54) CENTRIFUGAL COMPRESSOR

(71) Applicant: KABUSHIKI KAISHA TOYOTA JIDOSHOKKI, Aichi (JP)

(72) Inventors: Yoshiki Ishihara, Aichi (JP); Hiroaki Kato, Aichi (JP); Junya Suzuki, Aichi (JP); Takayuki Hirano, Aichi (JP)

(73) Assignee: KABUSHIKI KAISHA TOYOTA JIDOSHOKKI, Aichi (JP)

( * ) Notice: Subject to any disclaimer, the term of this patent is extended or adjusted under 35 U.S.C. 154(b) by 74 days.

(21) Appl. No.: 17/987,018

(22) Filed: Nov. 15, 2022

(65) Prior Publication Data

US 2023/0160390 A1 May 25, 2023

(30) Foreign Application Priority Data

Nov. 19, 2021 (JP) ..... 2021-188834

(51) Int. Cl.
*F04D 25/06* (2006.01)
*F04D 29/58* (2006.01)

(52) U.S. Cl.
CPC ..... *F04D 25/062* (2013.01); *F04D 29/5806* (2013.01)

(58) Field of Classification Search
CPC ..... F04D 25/062; F04D 29/5806; F04D 25/0606; F04D 29/0513; F04D 29/584; F04D 29/5846; F04D 29/056
See application file for complete search history.

(56) References Cited

U.S. PATENT DOCUMENTS 10,894,269 B2 1/2021 Hayashi et al.
2005/0210875 A1* 9/2005 Larue ..... F16C 17/042 60/602
2011/0076136 A1* 3/2011 Small ..... F04D 25/026 415/124.2
2011/0243762 A1* 10/2011 Daikoku ..... F02B 33/40 384/105
2014/0356145 A1* 12/2014 Gerber ..... F04D 29/624 277/303

(Continued)

FOREIGN PATENT DOCUMENTS

CN 112460056 A * 3/2021
CN 113123983 A * 7/2021

(Continued)

*Primary Examiner* — Dominick L Plakkoottam
(74) *Attorney, Agent, or Firm* — Greenblum & Bernstein, P.L.C.

(57) ABSTRACT

A centrifugal compressor that includes: a rotary shaft; a compressor impeller mounted on the rotary shaft and configured to rotate together with the rotary shaft to compress a fluid; a housing accommodating the rotary shaft and the compressor impeller; and a thrust bearing supporting the rotary shaft in a thrust direction such that the rotary shaft is rotatable. The housing includes: an impeller chamber in which the compressor impeller is accommodated; a thrust bearing accommodation chamber in which the thrust bearing is accommodated; and a partition wall separating the impeller chamber from the thrust bearing accommodation chamber. The partition wall has therein a cooling gas passage through which cooling gas flows to cool the thrust bearing and a cooling water passage through which cooling water flows to cool the partition wall.

5 Claims, 3 Drawing Sheets

(56) References Cited

U.S. PATENT DOCUMENTS

| | | | | |
|---|---|---|---|---|
| 2016/0298648 | A1* | 10/2016 | Graham | F04D 29/0513 |
| 2017/0002824 | A1* | 1/2017 | Hiwata | F04D 29/061 |
| 2019/0055954 | A1* | 2/2019 | Egawa | F04D 29/057 |
| 2019/0226393 | A1* | 7/2019 | Arakawa | F02B 39/08 |
| 2020/0256343 | A1* | 8/2020 | Sakota | F04D 25/082 |
| 2023/0304706 | A1* | 9/2023 | Moon | F04D 17/122 |

FOREIGN PATENT DOCUMENTS

| | | | | |
|---|---|---|---|---|
| JP | 2011202641 | A | * | 10/2011 |
| JP | 2013130086 | A | | 7/2013 |
| JP | 2017002750 | A | * | 1/2017 |
| JP | 2019127898 | A | | 8/2019 |
| JP | 6663467 | B2 | | 2/2020 |

* cited by examiner

CENTRIFUGAL COMPRESSOR

CROSS-REFERENCE TO RELATED APPLICATION

This application claims priority to Japanese Patent Application No. 2021-188834 filed on Nov. 19, 2021, the entire disclosure of which is incorporated herein by reference.

The present disclosure relates to a centrifugal compressor.

BACKGROUND ART

A known centrifugal compressor is mentioned, for example, in Japanese Patent Application Publication No. 2019-127898. The centrifugal compressor includes a rotary shaft and a compressor impeller. The compressor impeller is mounted on the rotary shaft. The compressor impeller is rotated together with the rotary shaft. The compressor impeller is configured to compress a fluid. The centrifugal compressor includes a housing for accommodating the rotary shaft and the compressor impeller. The centrifugal compressor further includes a thrust bearing. The thrust bearing supports the rotary shaft in a thrust direction such that the rotary shaft is rotatable.

The housing has an impeller chamber and a thrust bearing accommodation chamber. The impeller chamber accommodates the compressor impeller. The thrust bearing accommodation chamber accommodates the thrust bearing. The housing has a partition wall that separates the impeller chamber from the thrust bearing accommodation chamber.

The temperature of the fluid is increased by compression by the compressor impeller. If the heat of the compressed fluid transfers to the thrust bearing accommodated in the thrust bearing accommodation chamber via the partition wall, the heat of the fluid increases the temperature of the thrust bearing, thereby decreasing the durability of the thrust bearing. It is therefore necessary to increase the ability of the centrifugal compressor to cool the thrust bearing.

SUMMARY

In accordance with an aspect of the present disclosure, there is provided a centrifugal compressor that includes: a rotary shaft; a compressor impeller mounted on the rotary shaft and configured to rotate together with the rotary shaft to compress a fluid; a housing accommodating the rotary shaft and the compressor impeller; and a thrust bearing supporting the rotary shaft in a thrust direction such that the rotary shaft is rotatable. The housing includes: an impeller chamber in which the compressor impeller is accommodated; a thrust bearing accommodation chamber in which the thrust bearing is accommodated; and a partition wall separating the impeller chamber from the thrust bearing accommodation chamber. The partition wall has therein a cooling gas passage through which cooling gas flows to cool the thrust bearing and a cooling water passage through which cooling water flows to cool the partition wall.

Other aspects and advantages of the disclosure will become apparent from the following description, taken in conjunction with the accompanying drawings, illustrating by way of example the principles of the disclosure.

BRIEF DESCRIPTION OF DRAWINGS

The disclosure, together with objects and advantages thereof, may best be understood by reference to the following description of the presently preferred embodiments together with the accompanying drawings in which.

DESCRIPTION OF EMBODIMENTS

Figure 1:
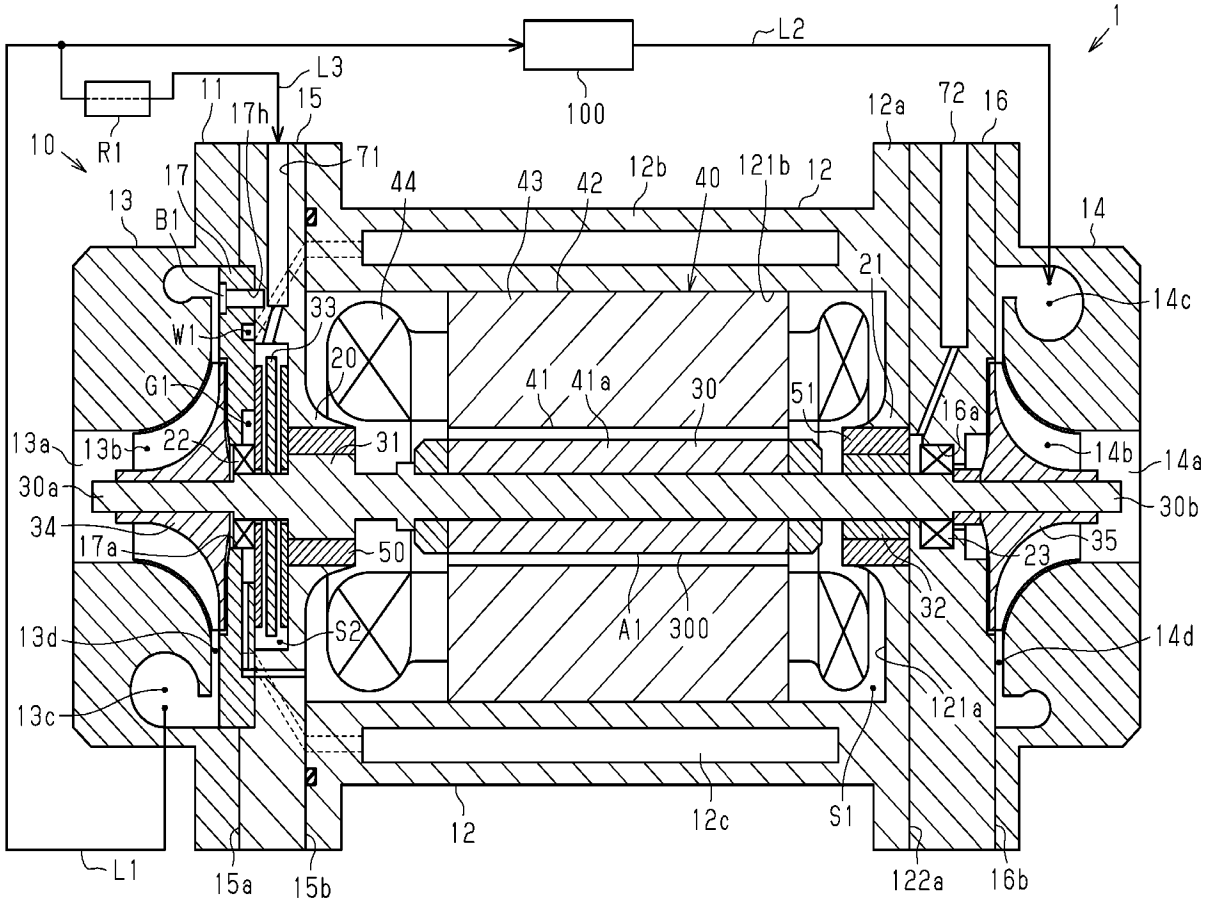
FIG. 1 is a sectional side view of a centrifugal compressor according to an embodiment of the present disclosure.
Figure 2:
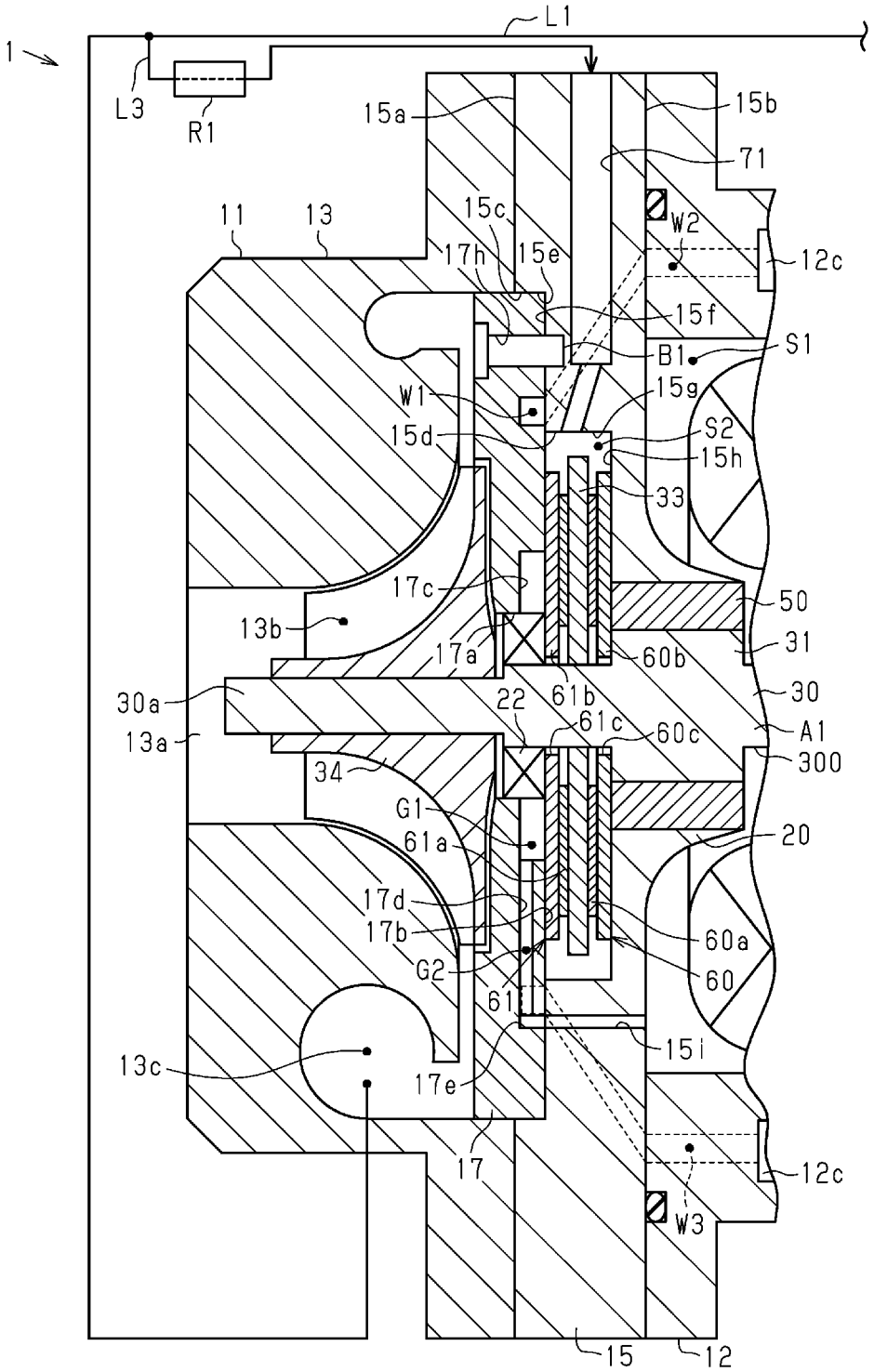
FIG. 2 is a fragmentary enlarged sectional side view of the centrifugal compressor according to the embodiment.
Figure 3:
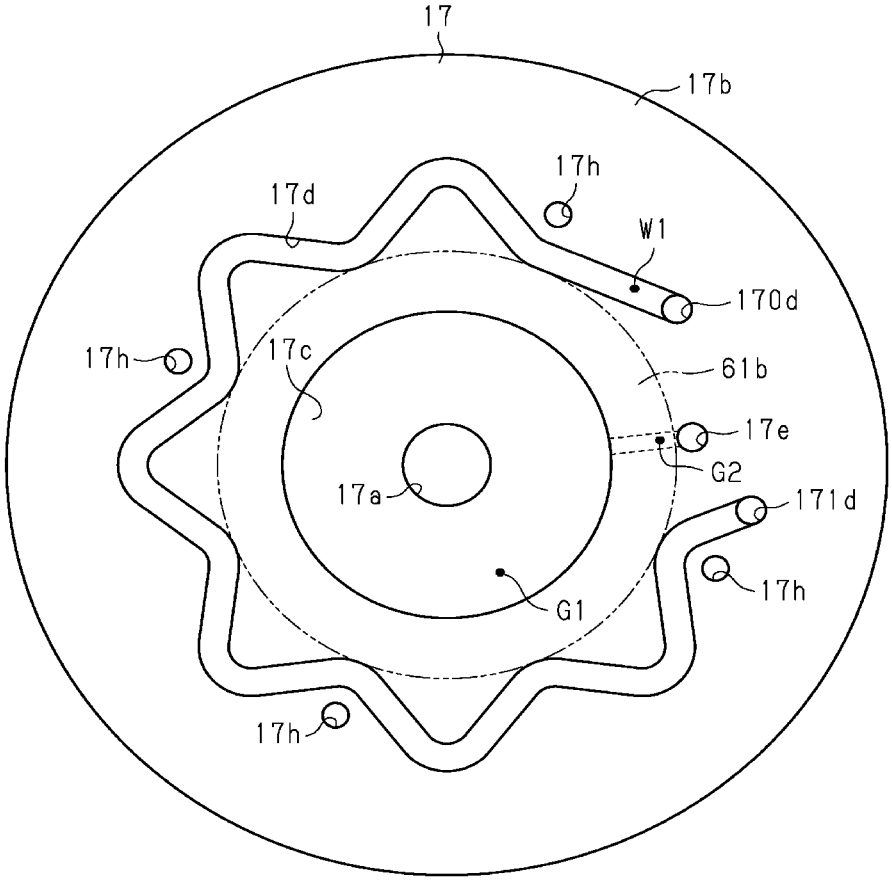
FIG. 3 is a front view of a seal plate.

The following will describe an embodiment of a centrifugal compressor with reference to accompanying FIGS. 1 to 3. The centrifugal compressor according to the embodiment is mounted on a fuel cell vehicle.

<Configuration of Centrifugal Compressor 10>

As illustrated in FIG. 1, a centrifugal compressor 10 includes a housing 11. The housing 11 is made of metal, such as aluminum. The housing 11 includes a motor housing 12, a compressor housing 13, a turbine housing 14, a first plate 15, a second plate 16, and a seal plate 17.

The motor housing 12 has a cylindrical shape. The motor housing 12 includes a plate-like end wall 12*a* and a peripheral wall 12*b*. The peripheral wall 12*b* has a cylindrical shape and protrudes from an outer peripheral portion of the end wall 12*a*. The first plate 15 is connected to an open end of the peripheral wall 12*b* of the motor housing 12 so as to close the opening of the peripheral wall 12*b*. The end wall 12*a* and the peripheral wall 12*b* of the motor housing 12 cooperate with the first plate 15 to define a motor chamber S1. The motor chamber S1 accommodates an electric motor 40.

As illustrated in FIG. 2, an end face 15*a* of the first plate 15 that is distant from the motor housing 12 has a first recess 15*c* and a second recess 15*d*. The first recess 15*c* and the second recess 15*d* each have a circular hole shape. The inner diameter of the first recess 15*c* is greater than that of the second recess 15*d*. The first recess 15*c* is formed coaxially with the second recess 15*d*. The first recess 15*c* has an inner peripheral surface 15*e* through which the end face 15*a* is connected to a bottom surface 15*f* of the first recess 15*c*. The second recess 15*d* has an inner peripheral surface 15*g* through which the bottom surface 15*f* of the first recess 15*c* is connected to a bottom surface 15*h* of the second recess 15*d*.

The first plate 15 has a first bearing holding portion 20. The first bearing holding portion 20 has a cylindrical shape. The first bearing holding portion 20 projects from the center portion of an end face 15*b* of the first plate 15 toward the electric motor 40. On the opposite side, the first bearing holding portion 20 is formed through the first plate 15 to open on the bottom surface 15*h* of the second recess 15*d*. The first bearing holding portion 20 is formed coaxially with the first recess 15*c* and the second recess 15*d*.

As illustrated in FIG. 1, the motor housing 12 has a second bearing holding portion 21. The second bearing holding portion 21 has a cylindrical shape. The second bearing holding portion 21 projects from the center portion of an inner surface 121*a* of the end wall 12*a* of the motor housing 12 toward the electric motor 40. The cylindrical second bearing holding portion 21 is formed through the end wall 12*a* of the motor housing 12 to open on an outer surface 122*a* of the end wall 12*a*. The first beating holding portion 20 is formed coaxially with the second bearing holding portion 21.

The second plate 16 is connected to the outer surface 122*a* of the end wall 12*a* of the motor housing 12. The second plate 16 has a shaft insertion hole 16*a* at the center portion of the second plate 16. The shaft insertion hole 16*a* is communicated with the second bearing holding portion 21. The shaft insertion hole 16*a* is formed coaxially with the second bearing holding portion 21.

As illustrated in FIG. 2, the seal plate 17 has a shaft insertion hole 17*a* at the center portion of the seal plate 17. The shaft insertion hole 17*a* is formed coaxially with the first bearing holding portion 20. The seal plate 17 has a plurality of bolt insertion holes 17*h* through which a plurality of bolts B1 is inserted. The bolt insertion holes 17*h* are formed in an outer peripheral portion of the seal plate 17 and spaced apart from each other around the shaft insertion hole 17*a*. FIG. 2 illustrates only one of the bolt insertion holes 17*h*. Each of the bolt insertion holes 17*h* has a circular hole shape. The seal plate 17 is fitted in the first recess 15*c* and fixed to the first plate 15 by the bolts B1 inserted through the bolt insertion holes 17*h*. The seal plate 17 closes the opening of the second recess 15*d*. The seal plate 17 has an end face 17*b* that is adjacent to the first plate 15 and cooperates with the second recess 15*d* of the first plate 15 to define a thrust bearing accommodation chamber S2.

The compressor housing 13 has a cylindrical shape. The compressor housing 13 has an inlet 13*a* that has a circular hole shape. The compressor housing 13 is connected to the end face 15*a* of the first plate 15 with the axis of the inlet 13*a* coaxial with the axis of the shaft insertion hole 17*a* of the seal plate 17 and the axis of the first bearing holding portion 20. The inlet 13*a* is opened on an end face of the compressor housing 13 that is distant from the first plate 15.

An impeller chamber 13*b*, a discharge chamber 13*c*, and a first diffuser passage 13*d* are formed between the compressor housing 13 and the seal plate 17. Accordingly, the seal plate 17 serves as a partition wall that separates the impeller chamber 13*b* from the thrust bearing accommodation chamber S2. The impeller chamber 13*b* is communicated with the inlet 13*a*. The discharge chamber 13*c* extends about the axis of the inlet 13*a* around the impeller chamber 13*b*. The impeller chamber 13*b* is communicated with the discharge chamber 13*c* through the first diffuser passage 13*d*. The impeller chamber 13*b* is communicated with the shaft insertion hole 17*a* of the seal plate 17.

As illustrated in FIG. 1, the turbine housing 14 has a cylindrical shape. The turbine housing 14 has an outlet 14*a* that has a circular hole shape. The turbine housing 14 is connected to an end face 16*b* of the second plate 16 that is distant from the motor housing 12 with the axis of the outlet 14*a* coaxial with the axis of the shaft insertion hole 16*a* of the second plate 16 and the axis of the second bearing holding portion 21. The outlet 14*a* is opened on an end face of the turbine housing 14 that is distant from the second plate 16.

A turbine chamber 14*b*, a suction chamber 14*c*, and a second diffuser passage 14*d* are formed between the turbine housing 14 and the end face 16*b* of the second plate 16. The turbine chamber 14*b* is communicated with the outlet 14*a*. The suction chamber 14*c* extends about the axis of the outlet 14*a* around the turbine chamber 14*b*. The turbine chamber 14*b* is communicated with the suction chamber 14*c* through the second diffuser passage 14*d*. The turbine chamber 14*b* is communicated with the shaft insertion hole 16*a*.

<Configuration of Rotating Member A1>

The centrifugal compressor 10 includes a rotating member A1. The rotating member A1 includes a rotary shaft 30, a first supporting portion 31, a second supporting portion 32, and a support plate 33. That is, the centrifugal compressor 10 includes the rotary shaft 30. The rotary shaft 30, the first supporting portion 31, the second supporting portion 32, and the support plate 33 are accommodated in the housing 11.

The axis of the rotary shaft 30 accommodated in the housing 11 is coaxial with the axis of the motor housing 12. The rotary shaft 30 has a first end portion 30*a*, and the rotary shaft 30 extends through the motor chamber S1, the first bearing holding portion 20, the thrust bearing accommodation chamber S2, and the shaft insertion hole 17*a* so that the first end portion 30*a* protrudes into the impeller chamber 13*b*. The rotary shaft 30 has a second end portion 30*b*, and the rotary shaft 30 extends through the motor chamber S1, the second bearing holding portion 21, and the shaft insertion hole 16*a* so that the second end portion 30*b* protrudes into the turbine chamber 14*b*.

A first sealing member 22 is disposed between the shaft insertion hole 17*a* of the seal plate 17 and the rotary shaft 30. The first sealing member 22 suppresses leak of air from the impeller chamber 13*b* toward the motor chamber S1. A second sealing member 23 is disposed between the shaft insertion hole 16*a* of the second plate 16 and the rotary shaft 30. The second sealing member 23 suppresses leak of air from the turbine chamber 14*b* toward the motor chamber S1. The first sealing member 22 and the second sealing member 23 are each a seal ring, for example.

The first supporting portion 31 is formed in a part of an outer peripheral surface 300 of the rotary shaft 30 adjacent to the first end portion 30*a*. The first supporting portion 31 is disposed inside the first bearing holding portion 20. The first supporting portion 31 is formed integrally with the rotary shaft 30. The first supporting portion 31 projects from the outer peripheral surface 300 of the rotary shaft 30.

The second supporting portion 32 is formed in a part of the outer peripheral surface 300 of the rotary shaft 30 adjacent to the second end portion 30*b*. The second supporting portion 32 is disposed inside the second bearing holding portion 21. The second supporting portion 32 is fixed to the outer peripheral surface 300 of the rotary shaft 30, and extends from the outer peripheral surface 300 of the rotary shaft 30 so as to have a ring shape. The second supporting portion 32 is rotatable together with the rotary shaft 30.

The support plate 33 is accommodated in the thrust bearing accommodation chamber S2. The support plate 33 is fixed to the outer peripheral surface 300 of the rotary shaft 30, and extends radially and outwardly from the outer peripheral surface 300 of the rotary shaft 30 so as to have a ring shape. That is, the support plate 33 is formed separately from the rotary shaft 30. The support plate 33 is rotatable together with the rotary shaft 30.

<Compressor Impeller 34>

The centrifugal compressor 10 includes a compressor impeller 34. The compressor impeller 34 is mounted on the first end portion 30*a* of the rotary shaft 30 in the axial direction of the rotary shaft 30. The compressor impeller 34 is disposed between the support plate 33 and the first end portion 30*a* of the rotary shaft 30. The compressor impeller 34 is accommodated in the impeller chamber 13*b*. That is, the housing 11 has the impeller chamber 13*b* in which the compressor impeller 34 is accommodated. The housing 11 accommodates the rotary shaft 30 and the compressor impeller 34. That is, the centrifugal compressor 10 includes the housing 11 accommodating the rotary shaft 30 and the compressor impeller 34. The compressor impeller 34 is rotated together with the rotary shaft 30.

<Turbine Wheel 35>

The centrifugal compressor 10 includes a turbine wheel 35. The turbine wheel 35 is mounted on the second end portion 30*b* of the rotary shaft 30. The turbine wheel 35 is disposed between the second supporting portion 32 and the second end portion 30*b* of the rotary shaft 30. The turbine wheel 35 is accommodated in the turbine chamber 14*b*. The turbine wheel 35 is rotated together with the rotary shaft 30.

<Configuration of Electric Motor 40>

The electric motor 40 includes a cylindrical rotor 41 and a cylindrical stator 42. The rotor 41 is fixed to the rotary shaft 30. The stator 42 is fixed in the housing 11. The rotor 41 is disposed radially inside the stator 42 and rotated together with the rotary shaft 30. The rotor 41 includes a cylindrical rotor core 41*a* fixed to the rotary shaft 30 and a plurality of permanent magnets, which is not illustrated, disposed in the rotor core 41*a*. The stator 42 surrounds the rotor 41. The stator 42 includes a stator core 43 and a coil 44. The stator core 43 has a cylindrical shape and is fixed to an inner peripheral surface 121*b* of the peripheral wall 12*b* of the motor housing 12. The coil 44 is wound around the stator core 43. The coil 44 receives current from a battery (not illustrated) so that the rotor 41 is rotated together with the rotary shaft 30. That is, the electric motor 40 is configured to rotate the rotary shaft 30. The electric motor 40 is disposed between the compressor impeller 34 and the turbine wheel 35 in the axial direction of the rotary shaft 30.

<First Radial Bearing 50 and Second Radial Bearing 51>

The centrifugal compressor 10 includes a first radial bearing 50 and a second radial bearing 51. The first radial bearing 50 has a cylindrical shape. The first radial bearing 50 is held by the first bearing holding portion 20. The second radial bearing 51 has a cylindrical shape. The second radial bearing 51 is held by the second bearing holding portion 21. The first radial bearing 50 and the second radial bearing 51 support the rotary shaft 30 in a radial direction such that the rotary shaft 30 is rotatable relative to the housing 11. The radial direction is a direction perpendicular to the axial direction of the rotary shaft 30.

<First Thrust Bearing 60 and Second Thrust Bearing 61>

As illustrated in FIG. 2, the centrifugal compressor 10 includes a thrust bearing, which, in this embodiment, is a first thrust bearing 60 and a second thrust bearing 61. The first thrust bearing 60 and the second thrust bearing 61 support the support plate 33 in a thrust direction such that the support plate 33 is rotatable relative to the housing 11. The thrust direction is a direction parallel to the axial direction of the rotary shaft 30.

The first thrust bearing 60 and the second thrust bearing 61 are accommodated in the thrust bearing accommodation chamber S2. That is, the housing 11 has the thrust bearing accommodation chamber S2 in which the first thrust bearing 60 and the second thrust bearing 61 are accommodated. The first thrust bearing 60 and the second thrust bearing 61 are disposed so as to hold therebetween the support plate 33. The second thrust bearing 61 and the support plate 33 are disposed between the compressor impeller 34 and the first thrust bearing 60. The second thrust bearing 61 is disposed between the compressor impeller 34 and the support plate 33. The first thrust bearing 60 has a first thrust bearing main body 60*a* and a first base portion 60*b*. The first base portion 60*b* has a disc shape. The first base portion 60*b* has a first through hole 60*c* through which the rotary shaft 30 is inserted. The second thrust bearing 61 has a second thrust bearing main body 61*a* and a second base portion 61*b*. The second base portion 61*b* has a disc shape. The second base portion 61*b* has a second through hole 61*c* through which the rotary shaft 30 is inserted.

<Fuel Cell System 1>

As illustrated in FIG. 1, the centrifugal compressor 10 serves as a part of a fuel cell system 1 mounted on a fuel cell vehicle. The fuel cell system 1 includes the centrifugal compressor 10, a fuel cell stack 100, a supply passage L1, a discharge passage L2, and a branched passage L3. The fuel cell stack 100 includes a plurality of fuel cells. For convenience of explanation, individual fuel cells of the fuel cell stack 100 are not illustrated in drawings. The fuel cell stack 100 is connected to the discharge chamber 13*c* through the supply passage L1. The fuel cell stack 100 is also connected to the suction chamber 14*c* through the discharge passage L2.

When the rotary shaft 30 rotates together with the rotor 41, the compressor impeller 34 and the turbine wheel 35 are rotated together with the rotary shaft 30. Air, which has been drawn through the inlet 13*a*, is compressed by the compressor impeller 34 in the impeller chamber 13*b*, and discharged from the discharge chamber 13*c* through the first diffuser passage 13*d*. That is, the compressor impeller 34 is rotated together with the rotary shaft 30 to compress air.

The air discharged from the discharge chamber 13*c* is supplied to the fuel cell stack 100 through the supply passage L1. The air supplied to the fuel cell stack 100 is used for electricity generation by the fuel cell stack 100. The used air is then discharged as exhaust from the fuel cell stack 100 to the discharge passage L2. The exhaust from the fuel cell stack 100 is drawn into the suction chamber 14*c* through the discharge passage L2. The exhaust drawn into the suction chamber 14*c* is then discharged to the turbine chamber 14*b* through the second diffuser passage 14*d*. The exhaust discharged into the turbine chamber 14*b* rotates the turbine wheel 35. The rotary shaft 30 is driven to rotate by the electric motor 40, and also by the rotation of the turbine wheel 35 by the exhaust from the fuel cell stack 100. The rotation of the turbine wheel 35 by the exhaust from the fuel cell stack 100 assists the rotation of the rotary shaft 30. The exhaust discharged into the turbine chamber 14*b* is discharged outside from the outlet 14*a*.

<Cooling Gas Passage G1 and Air in Cooling Gas Passage G1>

As illustrated in FIGS. 2 and 3, the seal plate 17 further has a recess 17*c* at the center portion of the end face 17*b* of the seal plate 17. The recess 17*c* has a circular hole shape. Most of the opening of the recess 17*c* is closed by the second base portion 61*b*. The recess 17*c* of the seal plate 17 and the second base portion 61*b* cooperate to define a cooling gas passage G1. The cooling gas passage G1 is communicated with the thrust bearing accommodation chamber S2 through a gap between the second through hole 61*c* of the second base portion 61*b* and the rotary shaft 30.

The seal plate 17 has a communication hole 17*e* and a connecting passage G2. The communication hole 17*e* has a circular hole shape. The communication hole 17*e* is opened on the end face 17*b* of the seal plate 17. The recess 17*c* is connected to the communication hole 17*e* through the connecting passage G2. The connecting passage G2 extends from the cooling gas passage G1 outwardly in the radial direction of the rotary shaft 30.

The first plate 15 has a through hole 15*i*. The through hole 15*i* is formed through the first plate 15 in the thickness direction of the first plate 15. The through hole 15*i* is formed coaxially with the communication hole 17*e*. One end of the through hole 15*i* is communicated with the communication hole 17*e*. The other end of the through hole 15*i* is communicated with the motor chamber S1. The communication hole 17*e* is communicated with the motor chamber S1 through the through hole 15*i*. The cooling gas passage G1 is communicated with the motor chamber S1 through the connecting passage G2, the communication hole 17*e*, and the through hole 15*i*.

Cooling gas for cooling the first thrust bearing 60 and the second thrust bearing 61 flows through the cooling gas passage G1. Specifically, the first plate 15 has a first passage 71. The first passage 71 extends in the radial direction of the rotary shaft 30. One end of the first passage 71 is opened on an outer surface of the first plate 15. The other end of the first passage 71 is communicated with the thrust bearing accommodation chamber S2. The second plate 16 has a second passage 72. The second passage 72 extends in the radial direction of the rotary shaft 30. One end of the second passage 72 is opened on an outer surface of the second plate 16. The other end of the second passage 72 is communicated with a part of the shaft insertion hole 16*a* adjacent to the motor housing 12 with respect to the second sealing member 23.

The branched passage L3 branches off from the supply passage L1. The supply passage L1 is connected to the first passage 71 through the branched passage L3. An intercooler R1 is disposed in the branched passage L3. The intercooler R1 cools the air flowing through the branched passage L3.

The air compressed by the compressor impeller 34 and flowed through the supply passage L1 toward the fuel cell stack 100 partly flows into the first passage 71 through the branched passage L3. The air in the first passage 71 has been cooled by the intercooler R1 while flowing through the branched passage L3. The air in the first passage 71 then flows into the thrust bearing accommodation chamber S2, and cools the first thrust bearing 60 and the second thrust bearing 61. That is, cooling gas for cooling the first thrust bearing 60 and the second thrust bearing 61 is part of the air compressed by the compressor impeller 34.

The air in the thrust bearing accommodation chamber S2 then flows into the cooling gas passage G1 through the gap between the second through hole 61*c* of the second base portion 61*b* and the rotary shaft 30. The air in the cooling gas passage G1 flows into the motor chamber S1 through the connecting passage G2, the communication hole 17*e*, and the through hole 15*i*.

The air flowed into the motor chamber S1 cools the electric motor 40. The air in the motor chamber S1 partly flows into a gap between the first radial bearing 50 and the first supporting portion 31, and cools the first radial bearing 50. The air in the motor chamber S1, for example, flows through a gap between the rotor 41 and the stator 42, and the air then flows into a gap between the second radial bearing 51 and the second supporting portion 32 to cool the second radial bearing 51. The air flows through the gap between the second radial bearing 51 and the second supporting portion 32, and is discharged to the outside of the housing 11 through the shaft insertion hole 16*a* and the second passage 72.

<Cooling Water Passage W1>

The end face 17*b* of the seal plate 17 has a groove 17*d*. On the end face 17*b* of the seal plate 17, the groove 17*d* is disposed outward of the recess 17*c* in the radial direction of the rotary shaft 30, and extends in the circumferential direction of the rotary shaft 30 so as to surround the recess 17*c*. The groove 17*d* is meandering about the axis of the shaft insertion hole 17*a*. Specifically, the groove 17*d* is formed of parts extending toward the axis of the shaft insertion hole 17*a* and parts extending away from the axis of the shaft insertion hole 17*a*, and those parts are alternatingly arranged. The groove 17*d* extends in the circumferential direction of the rotary shaft 30 such that the groove 17*d* is located inside in the radial direction of the rotary shaft 30 with respect to the bolt insertion holes 17*h*. The groove 17*d* has a first end 170*d* and a second end 171*d* that circumferentially extend over the whole circumference of the seal plate 17. The opening of the groove 17*d* is closed by the first plate 15. The groove 17*d* and the bottom surface 15*f* of the first recess 15*c* of the first plate 15 cooperate to define a cooling water passage W1. The cooling water passage W1 is formed outward of the cooling gas passage G1 in the radial direction of the rotary shaft 30. Cooling water flowing through the cooling water passage W1 is prevented from leaking by a sealing member (not illustrated) disposed between the end face 17*b* of the seal plate 17 and the bottom surface 15*f* of the first recess 15*c* of the first plate 15.

As illustrated in FIG. 1, the centrifugal compressor 10 further includes a cooling water jacket 12*c*. The cooling water jacket 12*c* is formed in the peripheral wall 12*b* of the motor housing 12. The cooling water jacket 12*c* circumferentially extends over the whole circumference of the peripheral wall 12*b*.

As illustrated in FIG. 2, the cooling water jacket 12*c* is connected to a first end of the cooling water passage W1 through a connecting cooling water passage W2. The cooling water jacket 12*c* is also connected to a second end of the cooling water passage W1 through a connecting cooling water passage W3.

The cooling water jacket 12*c* is further connected to a first end and a second end of an external passage (not illustrated) through which cooling water (long life coolant) flows. The cooling water in the external passage is cooled by heat exchange with outside air by a radiator (not illustrated) disposed in the external passage. The cooling water circulates from the external passage, through the cooling water jacket 12*c*, the connecting cooling water passage W2, the cooling water passage W1, and the connecting cooling water passage W3 in this order, to the cooling water jacket 12*c*. That is, the cooling water flows through the cooling water passage W1. The cooling water flowing through the cooling water passage W1 cools the seal plate 17. That is, the seal plate 17 has therein the cooling gas passage G1 through which the cooling gas flows so as to cool the first thrust bearing 60 and the second thrust bearing 61 and the cooling water passage W1 through which the cooling water flows so as to cool the seal plate 17.

<Operation>

Next, the following will explain the operation of the centrifugal compressor according to the embodiment.

The seal plate 17 has therein the cooling gas passage G1. Air cools the first thrust bearing 60 and the second thrust bearing 61, and further cools the seal plate 17 while flowing through the cooling gas passage G1. The seal plate 17 further has therein the cooling water passage W1. The cooling water flowing through the cooling water passage W1 cools the seal plate 17. That is, the heat of the air compressed by the compressor impeller 34 is less likely to transfer, via the seal plate 17, to the first thrust bearing 60 and the second thrust bearing 61 accommodated in the thrust bearing accommodation chamber S2. Accordingly, the first thrust bearing 60 and the second thrust bearing 61 are efficiently cooled by the air. Further, the heat of the first thrust bearing 60 and the second thrust bearing 61 transfers to the cooling water flowing through the cooling water passage W1.

<Advantageous Effects>

The aforementioned embodiment provides following advantageous effects.

(1) The seal plate 17 has therein the cooling gas passage G1. This allows air to cool the seal plate 17 by flowing through the cooling gas passage G1, while cooling the first thrust bearing 60 and the second thrust bearing 61. The seal plate 17 further has therein the cooling water passage W1, so that the cooling water further cools the seal plate 17. That is, the heat of the air compressed by the compressor impeller 34 is less likely to transfer, via the seal plate 17, to the first thrust bearing 60 and the second thrust bearing 61 accommodated in the thrust bearing accommodation chamber S2. Accordingly, the first thrust bearing 60 and the second thrust bearing 61 are efficiently cooled by the air. Further, the heat of the first thrust bearing 60 and the second thrust bearing 61 transfers to the cooling water flowing through the cooling water passage W1. This allows an increase in the ability of the centrifugal compressor to cool the first thrust bearing 60 and the second thrust bearing 61.

(2) The cooling water passage W1 is formed outward of the cooling gas passage G1 in the radial direction of the rotary shaft 30. This configuration allows an increase in area of the cooling water passage W1, compared to a case where the cooling water passage W1 is formed inward of the cooling gas passage G1 in the radial direction of the rotary shaft 30. Accordingly, the seal plate 17 is efficiently cooled. That is, the heat of the fluid compressed by the compressor impeller 34 is less likely to transfer, via the seal plate 17, to the first thrust bearing 60 and the second thrust bearing 61 accommodated in the thrust bearing accommodation chamber S2. Further, the heat of the first thrust bearing 60 and the second thrust bearing 61 is more likely to transfer to the cooling water flowing through the cooling water passage W1. This allows a further increase in the ability of the centrifugal compressor to cool the first thrust bearing 60 and the second thrust bearing 61.

<Modification Example>

The aforementioned embodiment may be modified as below. The embodiment may be combined with the following modification examples within technically consistent range.

In the embodiment, the cooling water passage W1 may be formed inward of the cooling gas passage G1 in the radial direction of the rotary shaft 30.

In the embodiment, the groove 17*d* is not necessarily meandering. That is, the shape of the groove 17*d* is not particularly limited.

In the embodiment, the cooling water flowing through the cooling water passage W1 is not necessarily the same as the cooling water flowing in the cooling water jacket 12*c*. That is, the method for supplying cooling water to the cooling water passage W1 is not particularly limited.

According to the embodiment, air cools the first thrust bearing 60 and the second thrust bearing 61 in the thrust bearing accommodation chamber S2, and then flows into the cooling gas passage G1. However, the configuration is not limited thereto. For example, the air may flow first into the cooling gas passage G1, and then into the thrust bearing accommodation chamber S2 to cool the first thrust bearing 60 and the second thrust bearing 61.

According to the embodiment, the air compressed by the compressor impeller 34 partly flows into the cooling gas passage G1 to serve as a cooling gas, but it is not limited thereto. The cooling gas may be air that is not the air compressed by the compressor impeller 34.

In the embodiment, the centrifugal compressor 10 does not necessarily include the turbine wheel 35.

In the embodiment, the centrifugal compressor 10 may include a compressor impeller instead of the turbine wheel 35. That is, each of the opposite ends of the rotary shaft 30 may have a compressor impeller, and a fluid compressed by one of the compressor impellers may be compressed again by the other of the compressor impellers.

In the embodiment, for example, the drive source of the centrifugal compressor 10 may be an engine.

In the embodiment, the centrifugal compressor 10 is not necessarily mounted on a fuel cell vehicle. For example, the centrifugal compressor 10 may be used for an air conditioner to compress refrigerant as a fluid. The centrifugal compressor 10 is not limited to a compressor mounted on a vehicle.

What is claimed is:

1. A centrifugal compressor comprising:

a rotary shaft;

a compressor impeller mounted on the rotary shaft, and configured to rotate together with the rotary shaft to compress a fluid;

a housing accommodating the rotary shaft and the compressor impeller; and a thrust bearing supporting the rotary shaft in a thrust direction such that the rotary shaft is rotatable, wherein the housing includes:

an impeller chamber in which the compressor impeller is accommodated;

a thrust bearing accommodation chamber in which the thrust bearing is accommodated; and a partition wall separating the impeller chamber from the thrust bearing accommodation chamber, and a part of the partition wall fully interposed between the impeller chamber and the thrust bearing accommodation chamber has therein a cooling gas passage through which cooling gas flows to cool the thrust bearing and a cooling water passage through which cooling water flows to cool the partition wall, wherein the partition wall defines portions of the impeller chamber and also defines portions of the thrust bearing accommodation chamber.

2. The centrifugal compressor according to claim 1, wherein the cooling water passage is formed outward of the cooling gas passage in a radial direction of the rotary shaft.

3. A centrifugal compressor comprising:

a rotary shaft;

a compressor impeller mounted on the rotary shaft, and configured to rotate together with the rotary shaft to compress a fluid;

a housing accommodating the rotary shaft and the compressor impeller; and a thrust bearing supporting the rotary shaft in a thrust direction such that the rotary shaft is rotatable, wherein the housing includes:

an impeller chamber in which the compressor impeller is accommodated;

a thrust bearing accommodation chamber in which the thrust bearing is accommodated; and a partition wall separating the impeller chamber from the thrust bearing accommodation chamber, and the partition wall has therein a cooling gas passage through which cooling gas flows to cool the thrust bearing and a cooling water passage through which cooling water flows to cool the partition wall, wherein the partition wall has an end face in an axial direction, and the end face is adjacent to and facing the thrust bearing accommodation chamber and has the cooling gas passage and the cooling water passage.

4. A centrifugal compressor comprising:

a rotary shaft;

a compressor impeller mounted on the rotary shaft, and configured to rotate together with the rotary shaft to compress a fluid;

a housing accommodating the rotary shaft and the compressor impeller; and a thrust bearing supporting the rotary shaft in a thrust direction such that the rotary shaft is rotatable, wherein the housing includes:

an impeller chamber in which the compressor impeller is accommodated;

a thrust bearing accommodation chamber in which the thrust bearing is accommodated; and a partition wall separating the impeller chamber from the thrust bearing accommodation chamber, and a part of the partition wall interposed between the impeller chamber and the thrust bearing accommodation chamber has therein a cooling gas passage through which cooling gas flows to cool the thrust bearing and a cooling water passage through which cooling water flows to cool the partition wall, wherein the partition wall defines portions of the impeller chamber and also defines portions of the thrust bearing accommodation chamber, and wherein the cooling gas passage is formed as a recess in an end face of the partition wall; and the cooling water passage is formed as a groove in the end face.

5. The centrifugal compressor according to claim 3, wherein the cooling gas passage is formed as a recess in the end face; and the cooling water passage is formed as a groove in the end face.

* * * * *